US007612024B2

(12) United States Patent
Li et al.

(10) Patent No.: US 7,612,024 B2
(45) Date of Patent: Nov. 3, 2009

(54) POLYALKYLENE GLYCOL BASED SOLUTIONS WITH ENHANCED HIGH TEMPERATURE STABILITY

(75) Inventors: Minyu Li, Oakdale, MN (US); Kimberly Person Hei, Baldwin, WI (US); Amy McBroom, St. Louis Park, MN (US)

(73) Assignee: Ecolab Inc., St. Paul, MN (US)

( * ) Notice: Subject to any disclaimer, the term of this patent is extended or adjusted under 35 U.S.C. 154(b) by 318 days.

(21) Appl. No.: 11/020,691

(22) Filed: Dec. 22, 2004

(65) Prior Publication Data

US 2006/0135377 A1 Jun. 22, 2006

(51) Int. Cl.
*C10M 105/76* (2006.01)
*C10M 107/34* (2006.01)

(52) U.S. Cl. ..... 508/202; 508/494; 508/389

(58) Field of Classification Search ..... 508/389, 508/202, 494

See application file for complete search history.

(56) References Cited

U.S. PATENT DOCUMENTS

| | | | | | |
|---|---|---|---|---|---|
| 4,149,983 | A | * | 4/1979 | Grier et al. | 508/257 |
| 4,332,692 | A | * | 6/1982 | Payne et al. | 8/137 |
| 4,458,068 | A | * | 7/1984 | Warner et al. | 536/91 |
| 4,465,849 | A | * | 8/1984 | Terae et al. | 556/450 |
| 4,790,856 | A | * | 12/1988 | Wixon | 8/137 |
| 4,828,735 | A | * | 5/1989 | Minagawa et al. | 508/507 |
| 5,104,563 | A | * | 4/1992 | Anchor et al. | 510/422 |
| 5,167,281 | A | * | 12/1992 | Kalfoglou | 166/275 |
| 5,559,087 | A | | 9/1996 | Halsrud | |
| 5,935,914 | A | | 8/1999 | Theyssen | |
| 2002/0025912 | A1 | * | 2/2002 | Hei et al. | 508/208 |
| 2003/0176302 | A1 | | 9/2003 | Li | |
| 2004/0053793 | A1 | | 3/2004 | Li | |

OTHER PUBLICATIONS

U.S. Appl. No. 10/978,962, filed Nov. 1, 2004, Li.
"Predicting Surfactant Cloud Point from Molecular Structure", Journal of Colloid and Interface Science 193, 132-136 (1997), Article CS975053, 5 pages.
"FDA Food Code", U.S. Department of Health and Human Services, available at www.cfsan.fda.gov/~dms/foodcode.html, 3 pages, 2001.
"McCutcheon's Emulsifiers & Detergents", 1999 North American Edition, 4 pages.
"21 CFR 178.3570", Food and Drugs, p. 397-399, 5 pages, 2001.
"21CFR 178.3400", Food and Drugs, p. 391-394, 8 pages, 2001.
www.geocities.com/NapaValley/6454, Tallyrand's "Culinary Fare", Oct. 24, 2001, 18 pages.
www.lubriplate.com, Jan. 17, 2001, 1 page.
www.taylorlabs.com, Jan. 17, 2001, 1 page.
www.conveyorsinc.net, Jan. 17, 2001, 1 page.
www.haynesmfg.com, Jan. 17, 2001, 1 page.
www.molyduval.com, Jan. 17, 2001, 25 pages.
www.gesilicones.com, Jan. 17, 2001, 1 pages.
www.emscience.com, Jan. 17, 2001, 1 page.
www.chem.com, Jan. 17, 2001, 2 pages.
www.calgati.com, Jan. 17, 2001, 1 page.
www.syncon-2000.com, Jan. 17, 2001, 1 page.
www.avatarcorp.com, Jan. 17, 2001, 3 pages.

* cited by examiner

*Primary Examiner*—Glenn Caldarola
*Assistant Examiner*—Jim Goloboy
(74) *Attorney, Agent, or Firm*—Andrew D. Sorensen

(57) ABSTRACT

This invention pertains to polyalkylene glycol based polymers with enhanced high temperature stability. More particularly, the invention pertains to compositions with enhanced high temperature stability comprising a polyalkylene glycol based polymer and an anionic surfactant.

15 Claims, No Drawings

POLYALKYLENE GLYCOL BASED SOLUTIONS WITH ENHANCED HIGH TEMPERATURE STABILITY

FIELD OF THE INVENTION

This invention pertains to polyalkylene glycol based polymers with enhanced high temperature stability. More particularly, the invention pertains to compositions with enhanced high temperature stability (i.e. increased cloud point) comprising a polyalkylene glycol based polymer and an anionic surfactant. The compositions of the present invention may be incorporated into other compositions for example into conveyor lubricant. The compositions of the present invention may include additional functional ingredients. The compositions of the present invention may be made using food additive ingredients that can be consumed safely by humans or mammals.

BACKGROUND

Polyalkylene glycol based polymers are well known synthetic lubricants because of their natural lubricity, low volatility and water solubility, as well as their noncorrosive nature to metals. Polyalkylene glycol based polymers are used in compressors, heat-transfer systems, refrigeration, and as a bearing and gear lubricants in severe-service applications. They may also find applications in surface treatment as surfactants. Some of them are suitable to be used in food processing. Polyalkylene glycol based polymers have also been used in the food and beverage industry for lubricating containers on conveyors. See U.S. Pat. Nos. 6,302,263, 6,288,012, 6,427,826, 6,214,777, and 6,495,494.

However, some of the polyalkylene glycols have low cloud points in that the solubility of the polymer in water decreases as the temperature increases. The result is that the polymers tend to phase separate as the temperature increases. The temperature that the polymer and water separate from each other is referred to as the "cloud point" because the phase separation forms a cloudy suspension. At temperatures below the cloud point, the polymer is completely water soluble and the polymer in water forms a clear solution. At the cloud point, the polymer phase separates from the water to form a cloudy suspension. At temperatures above the cloud point, the polymer completely phase separates from the water and the two phases are usually clearly visible.

Phase separation at temperatures above the cloud point is undesirable for several reasons. First, if the product is being pumped out of a container and the polymer and water are in separate layers, only one component will be pumped out at a time. This can lead to an ineffective product, for example when the polyalkylene glycol polymer is being used in a conveyor lubricant. Phase separation will also lead to problems with the dispensing of the polyalkylene glycol polymer due to plugging. Another problem caused by phase separation is dilution. Once phase separation occurs, dilution is more difficult because the viscosity is not uniform throughout the composition. Finally, once phase separation occurs, the polymer layer and the water layer do not return to a mixture once the temperature is lowered below the cloud point.

Use of polyalkylene glycol polymers with relatively low cloud points in compositions is usually very limited. Such polyalkylene glycol polymers typically have storage, shipping, and use limitations in that they cannot be incorporated into compositions that normally would be used as temperatures at or above the cloud point. Therefore, a need exists for compositions containing polyalkylene glycol polymers with increased cloud points.

SUMMARY

Surprisingly, it has been discovered that adding an anionic surfactant to a polyalkylene glycol polymer increases the cloud point temperature of the polyalkylene glycol polymer. The improved polyalkylene glycol polymer can then be incorporated into other compositions and used at temperatures above the normal cloud point temperature of the polyalkylene glycol polymer without the anionic surfactant. The composition may also comprise a polyalkylene glycol polymer, an anionic surfactant, and additional functional ingredients that enhance the effectiveness of the composition or provide other functional aspects to the composition. The invention includes a polyalkylene glycol polymer with an anionic surfactant in other compositions, for example, in a conveyor lubricant, compressors, heat-transfer systems, refrigeration, as a bearing gear lubricant, and anywhere else polyalkylene glycol polymer are used. The composition can be made using food additive ingredients that may be consumed safely by humans and mammals.

Accordingly, in one embodiment, the present embodiment relates to a composition with increased stability at high temperatures having a polyalkylene glycol polymer and an anionic surfactant where the anionic surfactant is present in an amount effective to increase the cloud point temperature of the polyalkylene glycol.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION OF SOME EMBODIMENTS

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5). As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

"Poly" means more than 1.

Any use or description of the terms "antimicrobial," "food additive," or the like herein does not mean that any resulting products are approved by a regulatory agency.

Applications

Polyalkylene glycol polymers are used in many applications. For example, polyalkylene glycol polymers are used, in compressors, heat-transfer systems, in refrigeration, as bearing and gear lubricants, in conveyor lubricants, and as surfactants. Polyalkylene glycol polymers are well known synthetic lubricants because of their natural lubricity, low volatility, water solubility, and non corrosive nature to metals.

When polyalkylene glycol polymers are included in conveyor lubricants, the conveyor lubricant usually has a decreased tendency to cause stress cracking in PET bottles, and the polyalkylene glycol polymer helps with detergency. Conveyor lubricants may also contain other components such as a variety of lubricants, surfactants, defoamers, solvents, antimicrobials, neutralizing agents, coupling agents, dispensing agents, anti wear agents, viscosity modifiers, sequestrants, biofilm reducing agents, dyes and oderants, anticorrosion agents, secondary lubricants, and the like.

Compositions

As discussed above, the invention generally relates to polyalkylene glycol polymer based compositions with increased cloud points. Specifically, the invention relates to a composition comprising a polyalkylene glycol polymer and an anionic surfactant. It has been discovered that adding an anionic surfactant to a polyalkylene glycol polymer based solution significantly increases the cloud point temperature of the solution. The terms "cloud point" refers to the temperature at which the polymer and water phase separate from each other. At temperatures below the cloud point, the polymer is completely soluble in water and the polymer in water forms a clear solution (i.e. the composition is stable). At around cloud point temperature, the polymer phase separates from the water to form a cloudy suspension. At temperatures above the cloud point, the polymer completely phase separates from the water and the two phase are usually clearly visible. In the present invention, a phase separated composition is considered an unstable composition. Whether a composition phase separated is determined visually. A person skilled in the art can readily ascertain by looking at a composition whether it is phase separated or not. Further, a person skilled in the art can formulate a composition to be stable and not phase separate. The cloud point of polyalkylene glycol polymers varies depending on the particular polyalkylene glycol polymer and the concentration. For example, the following table lists the cloud point temperatures of various polyalkylene glycol polymers.

| Trade Name | Chemical Type | Company | Cloud Point (1% surfactant in Aqueous System, measured in ° C.) |
|---|---|---|---|
| Pluronic L-61 | Block Copolymer | BASF | 24 |
| Pluronic L-72 | Block Copolymer | BASF | 25 |
| Pluronic L-92 | Block Copolymer | BASF | 26 |
| Pluronic L-122 | Block Copolymer | BASF | 19 |
| Dowfax D-683 | EO/PO Copolymer | Dow Chemical | 22 |
| Antarox L-61 | Block Copolymer | Rhodia | 22-26 |
| Antarox L-62 | Block Copolymer | Rhodia | 30-34 |

*Assuming that room temperature is 68-78° F. or 20-26° C.

The cloud point of the composition of the invention is preferably above ambient, above 100° F./38° C., above 120° F./49° C., and above 140° F./60° C.

There are several advantages to having polyalkylene glycol based solutions with a higher cloud point temperature. One advantage is the ability to develop polyalkylene glycol based solutions that are more stable at high temperatures. Another advantage is the ability to develop polyalkylene glycol polymer based solution that can be stored or used at high temperatures. Yet, another advantage is the ability to incorporate these polyalkylene glycol based solutions into final products that are used at higher temperatures and therefore bring certain desirable properties to those final products.

The composition may be composed of food additive ingredients that can safely be administered to or consumed by humans and mammals. In addition, the composition may optionally include additional, active or functional ingredients or components that enhance the effectiveness of the composition or provide other functional aspects to the composition.

While some polyalkylene glycol polymers have higher cloud points than others, it is understood that this invention can be used with any polyalkylene glycol polymer containing product that needs to have an increased cloud point temperature. For the compositions of the invention, the addition of the anionic surfactant preferably raises the cloud point temperature of the composition about at least 10 degrees Fahrenheit higher than the cloud point of the composition without the anionic surfactant, about at least 15 degrees Fahrenheit higher than the cloud point of the composition without the anionic surfactant, about at least 20 degrees Fahrenheit higher than the cloud point of the composition without the anionic surfactant, about at least 30 degrees Fahrenheit higher than the cloud point of the composition without the anionic surfactant, and about at least 50 degrees Fahrenheit higher than the cloud point of the composition without the anionic surfactant.

Polyalkylene Glycol Polymer

The term "polyalkylene glycol polymer" includes polymers of alkylene oxides or derivatives and mixtures or combinations thereof. For example, in some embodiments, polyalkylene glycol polymers can include polymers of the following general formula, and derivatives thereof:

$$H—O—(RO)_x—H$$

wherein R is a linear or branched alkyl, and x is a positive integer, and in some embodiments is in the range of about 2 to 500 for low molecular weight polyalkylene glycol polymers, and in some embodiments up to about hundreds of thousand for high molecular weight polyalkylene glycol polymers. Some examples of commercially available lower molecular weight polyalkylene glycol polymers include dipropylene glycol monomethyl ether, Carbowax™ and Ucon™ products available from Union Carbide, and some examples of commercially available higher molecular weight polyalkylene glycol products include POLYOX™ products available from Union Carbide.

As is apparent from above, the term "polyalkylene glycol polymer" also can include derivatives of such polyalkylene glycol polymers. Some examples of such derivatives can include polyalkylene glycol polymers modified by substitution on one or more of the terminal hydroxyl groups. For example, one or more of the terminal hydroxyl groups can be substituted with alkyl or acyl groups to form an ether, or a carbonyl group to form an ester. Some examples of such derivatives include compounds of the following formulas:

$$R'—O—(RO)_x—H \quad R'—COO—(RO)_x—H$$

wherein R' is linear or branched alkyl or aryl, and in some embodiments is in the range of $C_1$-$C_{26}$ alkyl or aryl, in some embodiments is in the range of $C_2$-$C_{18}$ alkyl or aryl, and in some embodiments is in the range of $C_{12}$ to $C_{18}$ alkyl or aryl. Some specific examples of such ether and ester derivatives of polyalkylene glycol include: Ethal SA20, Polyoxyethylene (20) stearyl alcohol from Ethox Chemicals, Lumulse 100-S, Polyethylene glycol 1000 monostearate from Lambent Technologies, myrj 45, Polyoxylene (8) stearate from Uniqema (ICI Surfactants).

The polyalkylene glycol polymer component can be in the form of a homopolymer, or mixtures or combinations of homopolymers, or can include copolymers, such as block or random copolymers, or mixtures of combinations of such copolymers, or can include mixtures or combinations of homopolymers and copolymers. In some examples, the polyalkylene glycol polymers range in molecular weight from about 50 to several million, in some embodiments from 50 to 100,000, in some embodiments from 50 to 20,000, and in some embodiments from 50 to 10,000. The polyalkylene glycol polymer components can be in liquid, paste, solid, gel, prill, pellet, or powder form.

In some particular embodiments, the polyalkylene glycol polymer includes homopolymers of polyethylene glycols, polypropylene glycols, or block and random copolymers of ethylene oxide and propylene oxide, and derivatives of mixtures of any of these. For example, block copolymers of ethylene oxide and propylene oxide are known in the art as nonionic surfactants and are commercially available. One example of a trade name for such block copolymers is Pluronics® manufactured by BASF.

One particular type of polyalkylene glycol polymer used in some embodiments includes ethylene oxide/propylene oxide copolymers wherein the polymer is prepared by the controlled addition of propylene oxide to the two hydroxyl groups of propylene glycol. Ethylene oxide is then added to sandwich this hydrophobe between hydrophilic groups, controlled by length to constitute from 10% to 80% (by weight) of the final molecule. This type of polymer is best illustrated by the following formula:

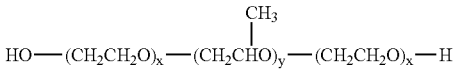

The x, y, and x' in the formula have no definite integers, but depend on the amount of ethylene oxide and propylene oxide in the desired polymer. In this particular embodiment, ethylene oxide constitutes anywhere from 10 to 80 wt-%.

A second type of block copolymer in some embodiments is that prepared by adding ethylene oxide to ethylene glycol to provide a hydrophile of designated molecular weight. Propylene oxide is then added to obtain hydrophobic blocks on the outside of the molecule thereby creating another sandwich. The structure of this polymer is illustrated as follows:

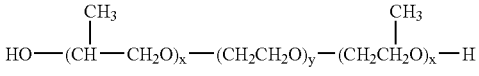

The content of ethylene oxide can range from 10 to 80 wt-%.

In some specific embodiments, the block copolymers are those between the molecular weight range of 800 to 40,000 and comprise polypropylene oxide sandwiched by polyethylene oxide blocks wherein the ethylene oxide constitutes from about 10 to 80 wt-% of a copolymer. One particular example of a useful block copolymer is that polymer identified as Pluronic® F-108, which has an average molecular weight of 14,600, a meltpour point of 57° C., is a solid at room temperature with a viscosity of 2,800 cps at 77° C., and a surface tension in dynes/cm of 41 at 25° C., @ 0.1%.

The polyalkylene glycol component can comprise a very broad range of weight percent of the entire composition, depending upon the desired properties. For example, the polyalkylene glycol polymer can comprise in the range of about 1 to about 99 wt. % polyalkylene glycol polymer component of the total weight, in some embodiments in the range of 1 to 75 wt. % polyalkylene glycol polymer component of the total weight, in some embodiments in the range of about 1 to about 50 wt. % polyalkylene glycol polymer component of total weight, and in some embodiments in the range of about 1 to about 25 wt. % polyalkylene glycol polymer component of the total weight.

Anionic Surfactant

The term "anionic surfactant" includes any surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and calcium, barium, and magnesium promote oil solubility.

As those skilled in the art understand, anionics are excellent detersive surfactants and are therefore, favored additions to heavy duty detergent compositions. Generally, however, anionics have high foam profiles which limit their use alone or at high concentration levels in cleaning systems such as CIP circuits that require strict foam control. Anionics are very useful additives to preferred compositions of the present invention. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N-($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic surfactant compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic surfactants suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at column 23, line 58 through column 29, line 23. Some non-limiting examples of food additive anionic surfactants include the following: dioctyl sodium sulfosuccinate (Aerosol OT available from CYTEC), sodium linear alkyl naphaline sulfonate (Petro LBA available from Crompton-Witco), and sodium lauryl sulfate (Stepanol WAC available from Stepan Company).

The anionic surfactant component of the invention can comprise up to about 50 wt. % of the polyalkylene glycol, anionic surfactant total weight. For example, the anionic surfactant can comprise in the range of about 0.5 to about 50 wt. % anionic surfactant component of the total weight, in the range of about 0.5 to about 30 wt. % anionic surfactant component of the total weight, or in the range of about 0.5 to about 20 wt. % anionic surfactant component of the total weight.

Solvent

The composition may optionally include a solvent. Water is the most commonly used and preferred solvent for carrying the various ingredients in the composition. It is possible, however, to use a water-soluble or water compatible solvent, such as alcohols and polyols. These solvents may be used alone or with water. Some examples of suitable alcohols include methanol, ethanol, propanol, butanol, and the like, as well as mixtures thereof. Some examples of polyols include glycerol, ethylene glycol, propylene glycol, diethylene glycol, and the like, as well as mixtures thereof.

The solvent component can comprise up to about 99.98 wt. % of the final composition. For example, the composition can comprise in the range of about 0 to about 99.98 wt. % solvent component of the total weight, in the range of about 0 to about 80 wt. % solvent component of the total weight, or in the range of about 0 to about 60 wt. % solvent component of the total weight.

Food Additive

The polyalkylene glycol compositions of the invention, or compositions they are incorporated into such as a conveyor lubricant, may come into contact with foods or beverages. It may be desirable that such compositions that come into contact with foods and beverages be suitable for human consumption such that when the composition or chemical comes into direct, indirect, or incidental contact with a food or beverage, it does not render the food or beverage unfit for consumption by humans or, mammals. "Direct, indirect, or incidental contact" means that the food or beverage acquires an amount of the lubricant. "Food or beverage" as used herein, means any substance ingested by humans or mammals, including liquid, solid, semisolid, composite comestible material in the form of water, carbonated beverage, a food, juice, sports beverage, snack, edible container, or carrier. The term "food additive" means that a composition or chemical may be consumed safely by humans or mammals. The food additive compositions or chemicals, when combined together to make the compositions of the invention, preferably both provide the desire characteristics of the invention, i.e. increased cloud point temperature, and pass the stringent guidelines of the Federal regulations.

Examples of anionic surfactants that are suitable food additives include dioctyl sodium sulfosuccinate, sodium linear naphthalene sulfonate, and sodium lauryl sulfate.

Examples of polyalkylene glycol polymers that are suitable food additives include Carbowax™ and Ucon™ products available from Union Carbide, or block and random copolymers of ethylene oxide and propylene oxide, and derivatives or mixtures of any of these. One example of a trade name for such block copolymers is Pluronics® manufactured by BASF.

Additional Functional Ingredients

Additional functional ingredients may optionally be used to improve the effectiveness of the composition. Some non-limiting examples of such additional active ingredients can include: surfactants, neutralizing agents, stabilizing/coupling agents, dispersing agents, antiwear agents, antimicrobial agents, foam inhibiters/generators, viscosity modifiers, sequestrants/chelating agents, a biofilm reducing agent, a dye, an anticorrosion agent, an antistatic agent, an oderant, a lubricant and secondary lubricant, mixtures of these and other ingredients useful in imparting a desired characteristic or functionality in the composition. The following describes some examples of such ingredients.

Surfactants

The composition may also contain additional surfactants to enhance the effectiveness of the composition such as cationic, amphoteric, and nonionic surfactants, or mixtures thereof. For a discussion on surfactants, see Kirk-Othmer, Surfactants in Encyclopedia of Chemical Technology, 19:507-593 (2d ed. 1969), which is incorporated by reference herein.

Some examples of cationic surfactants suitable for use include quaternary ammonium surfactants with one or two long chain fatty alkyl groups and one or two lower alkyl or hydroxyalkyl substituents. Preferable examples are alkylbenzyl dimethyl ammonium chloride wherein the alkyl groups are a stearyl, tallow, lauryl, myristyl moiety, and the like, and mixtures thereof.

Some examples of nonionic surfactants include polyalkylene oxide condensates of long chain alcohols such as alkyl phenols and aliphatic fatty alcohols. Some specific examples contain alkyl chains of $C_6$-$C_{18}$. Typical examples are polyoxyethylene adducts of tall oil, coconut oil, lauric, stearic, oleic acid, and the like, and mixtures thereof. Other nonionic surfactants can be polyoxyalkylene condensates of fatty acid amines and amides having from about 8 to 22 carbon atoms in the fatty alkyl or acyl groups and about 10 to 40 alkyloxy units in the oxyalkylene portion. An exemplary product is the condensation product of coconut oil amines and amides with 10 to 30 moles of ethylene oxide. It is possible to form a block copolymer by condensing different alkylene oxides with the same fatty acid amine or amide. An example is a polyoxalkylene condensate of a long chain fatty acid amine with three blocks of oxyalkylene units wherein the first and third block consists of propylene oxide moiety and the second block consists of ethylene oxide moiety. The block copolymer may be linear or branched.

Yet another kind of nonionics are alkoxylated fatty alcohols. Typical products are the condensation products of n-decyl, n-dodecyl, n-octadecyl alcohols, and a mixture thereof with 3 to 50 moles of ethylene oxide.

Some specifically suitable nonionics for the lubricant compositions are alkylene oxide adducts of relatively low degree of polymerization alkylglycosides. These oxyalkylated glycosides comprise a fatty ether derivative of a mono-, di-, tri-, etc. saccharide having an alkylene oxide residue. Preferable examples contain 1 to 30 units of an alkylene oxide, typically ethylene oxide, 1 to 3 units of a pentose or hexose, and an alkyl group of a fatty group of 6 to 20 carbon atoms. An oxyalkylated glycoside compares with the general formula of:

$$H\text{-}(AO)_m\text{-}G_y\text{-}O\text{—}R$$

where AO is an alkylene oxide residue; m is the degree of alkyl oxide substitution having an average of from 1 to about 30, G is a moiety derived from a reducing saccharide containing 5 or 6 carbon atoms, i.e. pentose or hexose; R is saturated or nonsaturated fatty alkyl group containing 6 to 20 carbon atoms; and y, the degree of polymerization (D.P.) of the polyglycoside, represents the number of monosaccharide repeating units in the polyglycoside, is an integer on the basis of individual molecules, but may be a noninteger when taken on an average basis when used as an ingredient for lubricants.

Some specific examples include sorbitan fatty acid esters, such as the Spans® and the polyoxyethylene derivatives of sorbitan and fatty acid esters known as the Tweens®. These are the polyoxyethylene sorbitan and fatty acid esters prepared from sorbitan and fatty esters by addition of ethylene oxide. Some specific examples of these are polysorbate 20, or polyoxyethylene 20 sorbitan monolaurate, polysorbate 40, or polyoxyethylene 20 sorbitan monopalmatate, polysorbate 60, or polyoxyethylene 20 sorbitan monostearate, or polysorbate 85, or polyoxyethylene 20 sorbitan triolyate.

Alternatively, in some embodiments, the invention can include a nonionic surfactant that is an alkylpolyglycoside. Alkylpolyglycosides (APGs) also contain a carbohydrate hydrophile with multiple hydroxyl groups.

APGs are fatty ether derivatives of saccharides or polysaccharides. The saccharide or polysaccharide groups are mono-, di-, tri-, etc. saccharides of hexose or pentose, and the alkyl group is a fatty group with 7 to 20 carbon atoms. Alkylpolyglycoside can be compared with the general formula of:

$$G_x\text{-}O\text{—}R$$

where G is moiety derived from a reducing saccharide containing 5 or 6 carbon atoms, i.e. pentose or hexose; and R is saturated or nonsaturated fatty alkyl group containing 6 to 20 carbon atoms; x, the degree of polymerization (D.P.) of the polyglycoside, representing the number of monosaccharide repeating units in the polyglycoside, is an integer on the basis of individual molecules, but may be a noninteger when taken on an average basis. In some embodiments, x has the value of less than 2.5, and in some embodiments is in the range or 1 and 2.

The reducing saccharide moiety, G can be derived from pentose or hexose. Exemplary saccharides are glucose, fructose, mannose, galactose, talose, gulose, allose, altrose, idose, arabinose, xylose, lyxose and ribose. Because of the ready availability of glucose, glucose is a common embodiment in the making of polyglycosides.

The fatty alkyl group in some embodiments is a saturated alkyl group, although unsaturated alkyl fatty group can be used. It is also possible to use an aromatic group such as alkylphenyl, alkylbenzyl and the like in place of the fatty alkyl group to make an aromatic polyglycoside.

Generally, commercially available polyglycosides have alkyl chains of $C_8$-$C_{16}$ and average degree of polymerization in the range of 1.4 to 1.6.

Neutralizing Agents

The invention can also include a neutralizing agent for various purposes. Some commonly used neutralizing agents are the alkaline metal hydroxides such as potassium hydroxide and sodium hydroxide. Another class of neutralizing agent is the alkyl amines, which may be primary, secondary, or tertiary or, alkanolamines, such as monoethanolamine, diethanolamine and triethanolamine, or cyclic amines such as morpholine.

Fatty alkyl substituted amines can also be used as neutralizing agents wherein the first substitute group of the amine is a saturated or unsaturated, branched or linear alkyl group having between 8 to 22 carbon atoms, alkyl group or hydroxyalkyl group having 1 to 4 carbons, or an alkoxylate group, and the third substitute group of the amine is an alkylene group of 2 to 12 carbons bonded to a hydrophilic moiety, such as —$NH_2$, —OR, $SO_3$, amine alkoxylate, alkoxylate, and the like. These amines can be illustrated by the formula:

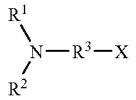

wherein $R^1$ is an alkyl group having between 8 to 22 carbon atoms, and $R^2$ is a hydrogen, alkyl group or hydroxyalkyl group having 1 to 4 carbons or an alkoxylate group, $R^3$ is an alkylene group having from 2 to 12 carbon atoms, and X is a hydrogen or a hydrophilic group such as —$NH_2$, —OR, —$SO_3$, amine alkoxylate, alkoxylate, and the like.

Examples of amines useful for neutralization are: dimethyl decyl amine, dimethyl octyl amine, octyl amine, nonyl amine, decyl amine, ethyl octyl amine, and the like, and mixtures thereof.

When X is —$NH_2$, preferable examples are alkyl propylene amines such as N-coco-1,3,diaminopropane, N-tallow-1,3,diaminopropane and the like, or mixtures thereof.

Examples of preferable ethoxylated amines are ethoxylated tallow amine, ethoxylated coconut amine, ethoxylated alkyl propylene amines, and the like, and mixtures thereof.

Stabilizing/Coupling Agents

Stabilizing agents, or coupling agents can be employed to keep the concentrate homogeneous, for example, under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as hexylene glycol, propylene glycol and the like.

Detergents/Dispersing Agents

Detergents or dispersing agents may also be added. Some examples of detergents and dispersants include alkylbenzenesulfonic acid, alkylphenols, carboxylic acids, alkylphosphonic acids, and their calcium, sodium, and magnesium salts, polybutenylsuccinic acid derivatives, silicone surfactants, fluorosurfactants, and molecules containing polar groups attached to an oil-solubilizing aliphatic hydrocarbon chain.

Some examples of suitable dispersing agents include triethanolamine, alkoxylated fatty alkyl monoamines and diamines such as coco bis (2-hydroxyethyl)amine, polyoxyethylene(5-)coco amine, polyoxyethylene(15)coco amine, tallow bis(-2 hydroxyethyl)amine, polyoxyethylene(15) amine, polyoxyethylene(5)oleyl amine and the like.

Antiwear Agents

Antiwear agents can also be added. Some examples of antiwear agents include zinc dialkyldithiophosphates, tricresyl phosphate, and alkyl and aryl disulfides and polysulfides. The antiwear and/or extreme pressure agents are used in amounts to give the desired results.

Antimicrobial Agents

Antimicrobial agents can also be added. Some useful antimicrobial agents include disinfectants, antiseptics, and preservatives. Some non-limiting examples include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, phosphonium compounds such as tetrakishydroxymethyl phosphonium sulphate (THPS), aldehydes such as glutaraldehyde, antimicrobial dyes such as acridines, triphenylmethane dyes and quinines and halogens including iodine and chlorine compounds. The antimicrobial agents can be used in amounts to provide the desired antimicrobial properties.

Foam Inhibitors/Generators

Foam inhibitors or foam generators can also be used. Some examples of foam inhibitors include methyl silicone polymers. Some examples of foam generators include surfactants such as nonionic, cationic, and amphoteric compounds. The foam inhibitors/generators can be used in amounts to provide the desired results. The foam modifiers can be used in an amount to give desired results.

Viscosity Modifiers

Viscosity modifiers can also be used. Some examples of viscosity modifiers include pour-point depressants and viscosity improvers, such as polymethacrylates, polyisobutylenes, polyacrylamides, polyvinyl alcohols, polyacrylic acids, high molecular weight polyoxyethylenes, butyl glucoside, and polyalkyl styrenes. The modifiers can be used in amounts to provide the desired results.

Sequestrants/Chelating Agents

In addition to the aforementioned ingredients, it is possible to include other chemicals in the composition. For example, where soft water is unavailable and hard water is used there is a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA), such as Versene products which are $Na_2EDTA$ and $Na_4EDTA$ sold by Dow Chemicals. Some additional examples of other sequestrants include: iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, sodium salt of sodium glucoheptonate, and the like.

Biofilm Reducing Agents

Biofilm reducing agents may optionally be included in the composition. Biofilms are a biological matrix formed on surfaces that contact water. Biofilms usually contain pathogens such as harmful bacteria. These pathogens are protected by the matrix from typical biocides and are therefore harder to kill than most pathogens. Biofilm growth and removal depend on several factors including the surface composition, and chemical composition of the surrounding environment.

There are several ways of removing biofilms including physically, chemically, and biologically. Examples of ways to physically remove biofilms include using magnetic fields, ultra sound, and high and low electrical fields. Physically removing the biofilms can be combined with chemical or biological methods of removing the biofilm. Examples of chemical and biological ways of removing biofilms include using a biofilm reducing agent. Examples of biofilm reducing agents are chelating agents such as EDTA and EGTA, chlorine, iodine, hydrogen peroxide, and antimicrobial proteins such as nisin such as that produced by *Lactococcus lactus*. Chelating agents destabilize the outer cell membrane of the biofilm. Chlorine, iodine, and hydrogen peroxide remove biofilms by depolymerizing the matrix.

Dyes and Oderants

Various dyes and oderants including perfumes and other aesthetic enhancing agents may also be included in the composition. Dyes may be included to alter the appearance of the composition or used as a monitoring tool, as for example, any water soluble or product soluble dye, any FD&C approved dye, Direct Blue 86 (Miles), Fastusol Blue (Mobay Chemical Corp), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keyston Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the composition include for example terpenoids such as citronellol, aldehydes such as amyl cinnamaldehyde, a jasmine such as C1S-jasmine or jasmal, vanillin, and the like.

Anticorrosion Agents

The composition may optionally include an anticorrosion agent. Anticorrosion agents provide compositions that generate surfaces that are shiner and less prone to biofilm buildup than surfaces that are not treated with anticorrosion agents. Preferred anticorrosion agents which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen 0 and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a surface.

Antistatic Agents

An antistatic agent may optionally be included in the composition. Examples of antistatic agents include long-chain amines, amides, and quaternary ammonium salts; esters of fatty acids and their derivatives; sulfonic acids and alkyl aryl sulfonates; polyoxyethylene derivatives; polyglycols and their derivatives; polyhydric alcohols and their derivatives; and phosphoric acid derivatives.

Lubricants and Secondary Lubricants

A variety of lubricants and secondary lubricants can be employed in the compositions, including hydroxy-containing compounds such as polyols (e.g., glycerol and propylene glycol); polytetrafluoroethylene (e.g. TEFLON®); polyalkylene glycols (e.g., the CARBOWAX™ series of polyethylene and methoxypolyethylene glycols, commercially available from Union Carbide Corp.); linear copolymers of ethylene and propylene oxides (e.g., UCON™ 50-HB-100 water-soluble ethylene oxide:propylene oxide copolymer, commercially available from Union Carbide Corp.); and sorbitan esters (e.g., TWEEN™ series 20, 40, 60, 80 and 85 polyoxyethylene sorbitan monooleates and SPAN™ series 20, 80, 83 and 85 sorbitan esters, commercially available from ICI Surfactants). Other suitable lubricants and secondary lubricants include phosphate esters, amines and their derivatives, and other commercially available lubricants and secondary lubricants that will be familiar to those skilled in the art. Derivatives (e.g., partial esters or ethoxylates) of the above lubricants can also be employed. For applications involving plastic containers, care should be taken to avoid the use of lubricants that might promote environmental stress cracking in plastic containers. Finally, a variety of silicone materials can be employed as a secondary lubricant, including silicone emulsions (such as emulsions formed from methyl (dimethyl), higher alkyl and aryl silicones; functionalized silicones such as chlorosilanes; amino-, methoxy-, epoxy- and vinyl substituted siloxanes; and silanols). Suitable silicone emulsions include E2175 high viscosity polydimethylsiloxane (a 60% siloxane emulsion commercially available from Lambent Technologies, Inc.), E2145 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30-60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones. Other silicone materials include finely divided silicone powders such as the TOSPEARL™ series (commercially available from Toshiba Silicone Co. Ltd.); and silicone surfactants such as WP30 anionic silicone surfactant, WAXWS-P nonionic silicone surfactant, QUATQ-400M cationic silicone surfactant and 703 specialty silicone surfactant (all commercially available from Lambent Technologies, Inc.). Preferred silicone emulsions typically contain from about 30 wt. % to about 70 wt. % water. Non-water-miscible silicone materials (e.g., non-water-soluble silicone fluids and non-water-dispersible silicone powders) can also be employed in the composition if combined with a suitable emulsifier (e.g., nonionic, anionic or cationic emulsifiers). For applications involving plastic containers (i.e., PET beverage bottles), care should be taken to avoid the use of emulsifiers or other surfactants that promote environmental stress cracking in plastic containers.

For a more complete understanding of the invention, the following examples are given to illustrate some embodiments. These examples and experiments are to be understood as illustrative and not limiting. All parts are by weight, except where it is contrarily indicated.

EXAMPLES

The following chart provides a brief explanation of certain chemical components used in the following examples:

TABLE 2

Trade Names and Corresponding Description of Some Chemicals Used in the Examples

| Trademark/Chemical Name | Description | Provider |
|---|---|---|
| Pluronic F-108 | EO/PO Block Copolymer | BASF |
| Aerosol OT | Anionic Surfactant | Cytec |
| Sodium Hydroxide | 50% solution | Dow |
| Oleic Acid, Coconut Fatty Acid | 9-Octadecenoic Acid, C10 Fatty Acid | Henkel |
| Ucon 50-HB-660 | EO PO Co-polymer | Union Carbide |

TABLE 2-continued

| Trade Names and Corresponding Description of Some Chemicals Used in the Examples | | |
|---|---|---|
| Trademark/Chemical Name | Description | Provider |
| Carbowax 300 | Homopolymer | Union Carbide |
| Ethal SA-20 | Nonionic surfactant | Ethox Chemicals |
| Sulfated Butyl Oleate | Anionic surfactant | Bayer |
| NaHNO3 | Neutralizing Agent | Multiple vendors |
| Span 20 | Sorbitan Monolaurate | Uniqema |
| Tween 80 | Nonionic surfactant | Uniqema |
| Petro LBA | Anionic Surfactant | Witco |
| Sodium Hydroxide | Neutralizing agent | Henkel |
| Sodium Lauryl Sulfate | Anionic Surfactant | Multiple vendors |
| Morpholine | Cyclic chemical with formula $C_4H_9NO$ | BASF |
| Disodium EDTA | Chelating Agent | Dow |
| Stepanol WA-LCP | Sodium lauryl sulfate | Stepan |
| Stepanol WAC | Sodium lauryl sulfate | Stepan |
| Rhodacal 1-246/L | Alpha olefin sulfonate sodium | Rhodia |
| Geropon T-77 | Sodium oleyl N-methyl taurate | Rhodia |
| Rhodafac RA-600 | Linear alcohol ethoxylate PE | Rhodia |
| Rhodafac RP-710 | Phone ethoxylate PE | Rhodia |
| Crodasinic LS 30 | Sodium lauryl sarcosinates | Croda |

Example 1

Example 1 shows the impact of the addition of an anionic surfactant to a solution of water and Ucon 50 HB 660, a polyalkylene glycol. The percentages are shown below as well as the cloud point. The test method used was similar to that described in Detergent Analysis: *A Handbook for Cost-Effective Quality Control*, Midwidsky & D. M. Gabriel, Micelle Press, 1982. Here the cloud point was measured by raising the temperature of the concentrate until cloudy. The solution was then mixed and the temperature observed until clear. That temperature was recorded. Table 3 provides the formulations used in Example 1. The materials listed are shown as the percent of material added to the total.

TABLE 3

| | Formulations | | | | | | |
|---|---|---|---|---|---|---|---|
| | Formula | | | | | | |
| | 1 | 2 | 3 | 4 | 5 | 6 | 7 |
| Water | 87 | 84 | 84 | 78 | 84 | 78 | 90 |
| 50HB660 | 10 | 10 | 10 | 10 | 10 | 10 | 10 |
| Aerosol OT | 3 | 6 | 0 | 0 | 0 | 0 | 0 |
| Petro LBA | 0 | 0 | 6 | 12 | 0 | 0 | 0 |
| SLS 30% | 0 | 0 | 0 | 0 | 6 | 12 | 0 |
| Total | 100 | 100 | 100 | 100 | 100 | 100 | 100 |
| Cloud Pt | 147° F. | 164° F. | 130° F. | 156° F. | 130° F. | 146° F. | 96° F. |

A solution of 10% Ucon 50 HB 660 in water has a cloud point of 96° F. (Formula 7). The addition of an anionic surfactant raised the cloud point to 130° F. or above in all cases (a 34% increase in temperature or better), however the best example was Aerosol OT at 6% (Formula 2) with a cloud point of 164° F., which represents a 71% increase in temperature.

Example 2

Example 2 shows the impact of a nonionic surfactant on the cloud point temperature compared to an anionic surfactant or no surfactant. Four formulas were constructed which included polyalkylene glycol, a block copolymer, fatty acid, and a neutralizer. Formula 1 did not include a surfactant. Formulas 2 and 4 included nonionic surfactants (Ethal SA-20 and Tween 80 respectively). Formula 3 included an anionic surfactant (Aerosol OT). The formulas were tested to determine the cloud point as described in Example 1, in order to see if the nonionic surfactants would be as effective at increasing the cloud point as the anionic surfactant or no surfactant. The formulas are listed in Table 4. The results are shown below.

TABLE 4

| | Formulations | | | |
|---|---|---|---|---|
| | Formula | | | |
| | #1 | #2 | #3 | #4 |
| Pluronic F-108 18% | 10 | 7 | 7 | 7 |
| Carbowax 300 | 7 | 7 | 7 | 7 |
| 50HB660 | 5 | 5 | 5 | 5 |
| Ethal SA-20 | 0 | 3 | 0 | 0 |
| Span 20 | 0 | 0 | 0 | 0 |
| Aerosol OT | 0 | 0 | 3 | 0 |
| Tween 80 | 0 | 0 | 0 | 3 |
| Oleic Acid | 1.7 | 1.7 | 1.7 | 1.7 |
| Water | 74.8 | 74.8 | 74.8 | 74.8 |
| Morpholine | 1 | 1 | 1 | 1 |
| Disod. EDTA | 0.5 | 0.5 | 0.5 | 0.5 |
| Total Solid | 25.2 | 25.2 | 25.2 | 25.2 |
| Cloud Point | 142° F. | 141° F. | 158° F. | 142° F. |

The results show that in the sample with the addition of an anionic surfactant, Aerosol OT, the cloud point was increased drastically. Formulas 2 and 4 looked at the addition of nonionics to raise the cloud point but were not as successful. Formula 1, which did not include a surfactant, has a cloud point of 142° F. Formulas 2 and 4 had cloud points of 141° F. and 142° F. respectively. Thus, formulas 2 and 4 were not effective at improving the cloud point because the cloud point did not change from the formula without a surfactant.

Example 3

Seven formulas were constructed which included polyalkylene glycol, a block copolymer, fatty acid, a neutralizer and anionic surfactants in order to determine the impact of adding one anionic surfactant to the formula on cloud point temperature. The formulas were tested to determine cloud point as described in Example 1. Table 5 shows the formulations used. The numbers are given as the percent of the component added to the total.

TABLE 5

| | Formulations | | | | | | |
|---|---|---|---|---|---|---|---|
| | Formula | | | | | | |
| | #1 | #2 | #3 | #4 | #5 | #6 | #7 |
| Oleic Fatty Acid | 4 | 4 | 4 | 4 | 4 | 4 | 4 |
| Coco Fatty Acid | 1 | 1 | 1 | 1 | 1 | 1 | 1 |
| Ethal SA 20 | 12 | 12 | 12 | 12 | 12 | 12 | 12 |
| Pluronic F-18% 108 | 5 | 5 | 5 | 5 | 5 | 5 | 5 |
| Sulf. Butyl Oleate | 6 | 6 | 6 | 6 | 2 | 2 | 2 |
| Aerosol OT | 0 | 2 | 2 | 4 | 2 | 2 | 4 |
| Ucon 50HB660 | 9 | 9 | 4.5 | 4.5 | 9 | 4.5 | 4.5 |
| Water | 63 | 61 | 65.5 | 63.5 | 65 | 69.5 | 67.5 |
| Cloud Point | 117° F. | 128° F. | 138° F. | 153° F. | 118° F. | 132° F. | 140° F. |

Formulas 1 and 2 tested the impact of the addition of Aerosol OT on cloud point temperature in the presence of a polyalkylene glycol polymer, Ucon 50HB660, and another anionic surfactant, sulfated butyl oleate. The amounts of polyalkylene glycol polymers and sulfated butyl oleate remained constant. Formula 1 did not include Aerosol OT and had a cloud point temperature of 117° F. Formula 2 added 2% of Aerosol OT to the total composition. The cloud point temperature increased by 11 degrees in Formula 2 from 117° F. in Formula 1 to 128° F. in Formula 2 (a 9% increase in temperature). This increase shows that adding more anionic surfactant to the formula increases the cloud point temperature of the formula.

Formulas 2 and 3 show the impact of decreasing the amount of polyalkylene glycol polymers when the amount of anionic surfactant remains constant. The amount of polyalkylene glycol polymer, Ucon 50HB660, decreased from 9% of the total composition in Formula 2 to 4.5% of the total composition in Formula 3. As a result, the cloud point temperature increased in Formula 3 by 10 degrees from 128° F. in Formula 2 to 138° F. in Formula 3 (an 8% increase in temperature). Again, this shows that increasing the amount of anionic surfactant relative to the amount of polyalkylene glycol polymer raises the cloud point temperature of the composition. This principle is also demonstrated by comparing Formula 3 to Formula 4. The amount of Aerosol OT was increased from 2% of the total composition in Formula 3 to 4% of the total composition in Formula 4. The amount of sulfated butyl oleate remained constant between Formulas 3 and 4, thus the overall anionic surfactant was increased by 2% in Formula 4. The amount of polyalkylene glycol polymer remained constant between Formulas 3 and 4. When the amount of anionic surfactant was increased relative to the polyalkylene glycol polymer in Formula 4, the cloud point temperature increased 15 degrees from 138° F. in Formula 3 to 153° F. in Formula 4 (an 11% increase in temperature). Formulas 5 and 6 and Formulas 6 and 7 also demonstrate that increasing the anionic surfactant relative to the polyalkylene glycol polymer increases the cloud point temperature. In Formula 6, the cloud point temperature increased 14 degrees (a 12% increase in temperature) when the polyalkylene glycol polymer was reduced from 9% of the total composition in Formula 5 to 4.5% of the total composition in Formula 6 but the anionic surfactant remained constant. In Formula 7, the polyalkylene glycol polymer remained constant but the anionic surfactant increased and the cloud point temperature increased by 8 degrees from Formula 6 (a 6% increase in temperature).

Example 4

Example 4 tested the impact of different classes of anionic surfactants on cloud point temperature. For this example, the anionic surfactants in Table 6 were compared.

TABLE 6

| Anionic Surfactants | | | |
|---|---|---|---|
| Trade Name | Chemical Name | Classification | % Active |
| Aerosol OT | Dioctyl Sodium Sulfonate | (Sulfonates/ Sulfosuccinate) | 100 |
| Stepanol WA-LCP | Sodium Lauryl Sulfate | (Sulfates) | 30 |
| Stepanol WAC | Sodium Lauryl Sulfate | (Sulfates) | 30 |
| Petro LBA | Alkyl Napthelene Sulfonate | (Sulfonates) | 50 |
| Rhodacal 1-246/L | Alpha Olefin Sulfonate, sodium | (Sulfonates) | 40 |
| Geropon T-77 | Sodium Oleyl N-Methyl Taurate | (Taurate) | 100 |
| Rhodafac RA-600 | Linear Alkcohol Ethoxylate PE | (Phosphate Ester) | 100 |
| Rhodafac RP-710 | Alkylphenol Ethoxylate | (Phosphate Ester) | 100 |
| Crodasinic LS30 | Sodium Lauryl Sarcosinate | (Sarcosinate) | 30 |

Formulas were prepared using a polyalkylene glycol polymer alone in water and then with each of the anionic surfactants described in Table 6. The formulas are shown in Table 7.

TABLE 7

Increased Cloud Point of Polyalkylene Glycol When Subjected to Anionic Surfactants

| Trade Name | Chemical Name | Grams (w/w) | | | | | | | | | |
|---|---|---|---|---|---|---|---|---|---|---|---|
| Ucon 50HB660 | EO-PO Copolymer | 2 | 2 | 2 | 2 | 2 | 2 | 2 | 2 | 2 | 2 |
| Aerosol OT | Dioctyl Sodium Sulfonate | | 1 | | | | | | | | |
| Stepanol WA-LCP | Sodium Lauryl Sulfate | | | 1 | | | | | | | |
| Stepanol WAC | Sodium Lauryl Sulfate | | | | 1 | | | | | | |
| Petro LBA | Alkyl Napthelene Sulfonate | | | | | 1 | | | | | |
| Rhodacal 1-246/L | Alpha Olefin Sulfonate, sodium | | | | | | 1 | | | | |
| Geropon T-77 | Sodium Oleyl N-Methyl Taurate | | | | | | | 1 | | | |
| Rhodafac RA-600 | Linear Alkcohol Ethoxylate PE | | | | | | | | 1 | | |
| Rhodafac RP-710 | Alkylphenol Ethyoxylate | | | | | | | | | 1 | |
| Crodasinic LS30 | Sodium Lauryl Sarcosinate | | | | | | | | | | 1 |
| Water | DI Water | 18 | 17 | 17 | 17 | 17 | 17 | 17 | 17 | 17 | 17 |
| Total | | 20 | 20 | 20 | 20 | 20 | 20 | 20 | 20 | 20 | 20 |
| Time in Microwave to induce cloud point | Seconds | 15 | 30 | 25 | 25 | 20 | 15 | 20 | 15 | 15 | 20 |
| Cloud Point | ° F. | 110 | 164 | 136 | 137.7 | 128 | 127.5 | 125 | 121.3 | 119 | 134.7 |

*Note: Raw Material Percent Active was not taken into consideration during formulation.

The formulas in Table 7 were prepared in a vial. They were then placed in the microwave and heated for 10-30 seconds to induce the cloud point. When the formula turned cloudy, the vial was removed from the microwave and a temperature probe inserted in the vial. The probe was used to stir the solution until it became clear. The temperature at which the formula turned clear was recorded in the table. All of the anionic surfactants were able to raise the cloud point temperature of the polyalkylene glycol. The most effective was the Aerosol OT (which increased the cloud point by 54° F. The least effective was the Rhodafac RP-710 which increased the cloud point by 9° F.

The foregoing summary, detailed description, and examples provide a sound basis for understanding the invention, and some specific example embodiments of the invention. Since the invention can comprise a variety of embodiments, the above information and embodiments are not intended to be limiting. Additional embodiments can practice the invention.

The invention resides in the claims.

What is claimed is:

1. A conveyor lubricant composition comprising:

a) a polyalkylene glycol polymer;

b) an anionic surfactant present at about 20 to about 50% by weight of the polyalkylene glycol polymer/anionic surfactant total weight; and c) a silicone emulsion, wherein the anionic surfactant increases the cloud point temperature of the polyalkylene glycol polymer by at least about 5° F.

2. The composition of claim 1, wherein the polyalkylene glycol polymer comprises a homopolymer.

3. The composition of claim 1, wherein the polyalkylene glycol polymer comprises a copolymer of ethylene oxide and propylene oxide.

4. The composition of claim 1, wherein the polyalkylene glycol polymer comprises a block copolymer.

5. The composition of claim 1, wherein the anionic surfactant is selected from the group consisting of sulfates, sulfonates, sulfosuccinates, sulfosuccinamates, sulfonated esters, sulfonated amides, phosphate esters, anionic carboxylates, or mixtures thereof.

6. The composition of claim 5, wherein the anionic surfactant is selected from the group consisting of dioctyl sodium sulfosuccinate, sodium linear alkyl naphthalene sulfonate, sodium lauryl sulfate, or mixtures thereof.

7. The composition of claim 1, further comprising a solvent.

8. The composition of claim 1; wherein the composition further comprises additional functional ingredients.

9. The composition of claim 8, wherein the additional functional ingredients comprise a surfactant, a neutralizing agent, a stabilizing agent, a coupling agent, a dispersing agent, an antiwear agent, an antimicrobial agent, a foam inhibitor, a foam generator, a viscosity modifier, a sequestrant, a chelating agent, a biofilm reducing agent, a dye, an anticorrosion agent, an antistatic agent, an oderant, a lubricant, a secondary lubricant, or mixtures thereof.

10. The composition of claim 1, wherein the composition can be safely administered to humans or mammals.

11. The composition of claim 1, wherein the composition is composed of food additives.

12. The composition of claim 1, wherein the anionic surfactant is present in an amount effective to increase the cloud point temperature of the polyalkylene glycol polymer by at least about 20° F.

13. The composition of claim 1, wherein the anionic surfactant is present in an amount effective to increase the cloud point temperature of the polyalkylene glycol polymer by at least about 30° F.

14. The composition of claim 1, wherein the anionic surfactant is present in an amount effective to increase the cloud point temperature of the polyalkylene glycol polymer by at least about 40° F.

15. The composition of claim 1, wherein the anionic surfactant is present in an amount effective to increase the cloud point temperature of the polyalkylene glycol polymer by at least about 50° F.

* * * * *